US005746092A

United States Patent [19]

Baba

[11] Patent Number: 5,746,092

[45] Date of Patent: May 5, 1998

[54] VISCOUS COUPLING GEAR DEVICE

[75] Inventor: Koji Baba, Tokyo, Japan

[73] Assignee: Seiko Clock Inc., Japan

[21] Appl. No.: 535,520

[22] Filed: Sep. 28, 1995

[30] Foreign Application Priority Data

Sep. 28, 1994 [JP] Japan ..... 6-233278

[51] Int. Cl.[6] ..... G04C 3/14

[52] U.S. Cl. ..... 74/421 R; 368/157; 368/160

[58] Field of Search ..... 74/421 R; 368/157, 368/160, 155; 188/293

[56] References Cited

U.S. PATENT DOCUMENTS

| | | | |
|---|---|---|---|
| 3,961,213 | 6/1976 | Koike et al. | 368/168 |
| 4,885,730 | 12/1989 | Miyazawa | 368/157 |
| 4,910,721 | 3/1990 | Hayakawa et al. | 368/155 |
| 5,151,886 | 9/1992 | Miyazawa | 368/157 |
| 5,197,045 | 3/1993 | Miyazawa | 368/157 |

FOREIGN PATENT DOCUMENTS

| | | | |
|---|---|---|---|
| 4-219537 | 8/1992 | Japan | 188/293 |
| 1441210 | 6/1976 | United Kingdom . | |
| 2197969 | 6/1988 | United Kingdom . | |
| 2253891 | 9/1992 | United Kingdom | 188/293 |
| 2281605 | 3/1995 | United Kingdom . | |

*Primary Examiner*—Rodney H. Bonck
*Assistant Examiner*—Troy Grabow
*Attorney, Agent, or Firm*—Adams & Wilks

[57] ABSTRACT

A viscous coupling gear device has a first case having a protrusion extending from a surface thereof, and a second case having a surface facing the surface of the first case and a protrusion extending from the surface of the second case. A gear has a driving portion for driving engagement with a first rotary member undergoing intermittent rotation and for transmitting intermittent rotation to the gear, a tubular portion extending from the gear and mounted on the protrusion of the first case for relative rotation therewith, and a tubular wall portion extending from the gear and disposed coaxially with and spaced from the tubular portion to define a cavity therebetween, the protrusion of the second case extending into the cavity and defining, together with the cavity and the tubular wall portion, a clearance. A driving member engages with a second rotary member for transmitting rotation of the gear to the second rotary member. A viscous fluid is disposed in the clearance for absorbing a velocity variation due to the intermittent rotation of the first rotary member so that the driving member transmit a smooth and continuous rotary motion to the second rotary member.

19 Claims, 1 Drawing Sheet

VISCOUS COUPLING GEAR DEVICE

BACKGROUND OF THE INVENTION

1. Field of the Invention

The present invention relates generally to a gear device, and more particularly to a viscous coupling gear device which enables a rotary member to undergo substantially smooth and continuous rotary motion when a stepping motor is used as a source of driving force.

2. Background Information

The mechanism of a quartz clock is such that the rotation of a driving -motor is transmitted to a second wheel through a gear train to rotate the second wheel, and the rotation of the second wheel is usually reduced for rotating a minute wheel of which the rotation is in turn reduced for rotating an hour wheel. A stepping motor having only a very low battery power consumption is employed as the driving motor. The stepping motor undergoes an intermittent rotary motion, and the second wheel is, therefore, designed to undergo intermittent motion at intervals of a second. However, consumers have long desired a clock mechanism in which the second wheel undergoes a sweeping motion to enable an indicating hand connected to the second wheel to indicate the progress of time continuously.

A sweeping motor has been employed in clock mechanisms for realizing a sweeping motion of the second wheel. However, sweeping motors have the drawbacks of being expensive to manufacture and having a high battery power consumption.

Proposals have been made for use of motion converting means for imparting a continuous rotary motion to the second wheel in the mechanism of a clock employing a stepping motor as a source of driving force (see, e.g. Japanese Utility Model Application KOKAI No. Hei 2-128994). The proposals include transmitting the rotation of a stepping motor through a gear train to a gear fixed to a bush fitted loosely about a second shaft, and imparting continuous rotation to the second shaft by a motion converting means provided in a rotation transmitting circuit following the bush.

The proposed motion converting means includes, as a first means, a disk positioned above the bush fitted loosely about the second shaft and surrounding the bush rotatably with the second shaft, while a spiral spring is connected between the bush and the disk to absorb a variation in velocity due to intermittent motion.

As a second means, the motion converting means includes a plate-like member fitted loosely about the end of the second shaft and connected to the disk by a spring so as to be driven by the disk and thereby absorb a difference in velocity due to intermittent motion.

As a third means, the motion converting means includes a viscous fluid, such as a lubricant, filling a tightly sealed container in which the plate-like member is held, so that the viscosity resistance which results from the rotation of the plate-like member in the viscous fluid imparts a smooth continuous rotary motion to the second shaft.

The first, second, and third means of the motion converting means described above are intended to absorb velocity discontinuities resulting from the intermittent motion of a stepping motor and achieve the continuous rotation of a second wheel. However, since the first, second, and third means are superposed upon one another axially on the second shaft, the thickness of the clock mechanism is increased. Thus, conventional clock mechanisms employing a motion converting means for converting the intermittent motion of a stepping motor to continuous rotary motion are expensive to manufacture and difficult to miniaturize.

SUMMARY OF THE INVENTION

An object of the present invention is to provide a viscous coupling gear device which enables a rotary member to undergo substantially smooth continuous rotary motion when a stepping motor is used as a source of driving force.

Another object of the present invention is to provide a viscous coupling gear device which has a small thickness and can be miniaturized, which has a simple construction and is simple to manufacture, and which is suited to mass-production at low cost.

Another object of the present invention is to provide a clock movement using a stepping motor as a source of driving force and which has a simple construction and can be miniaturized.

The foregoing and other objects of the present invention are carried out by a viscous coupling gear device having a disk portion with a tubular wall projecting from one side thereof, the wall being surrounded by a pinion and surrounding a cavity in which a protrusion extending from a case facing the pinion is loosely fitted. The cavity and the protrusion define therebetween a clearance in which a viscous fluid is disposed.

DETAILED DESCRIPTION OF THE PREFERRED EMBODIMENT

A preferred embodiment of the present invention will now be described with reference to the accompanying drawing.

The preferred embodiment of the present invention is described below with a specific application to a clock movement using a stepping motor as a source of driving force. However, it will be appreciated by those of ordinary skill in the art that the viscous coupling gear device of the present invention is also particularly well adapted for other electronic apparatuses using a stepping motor as a source of driving force.

Figure 1:
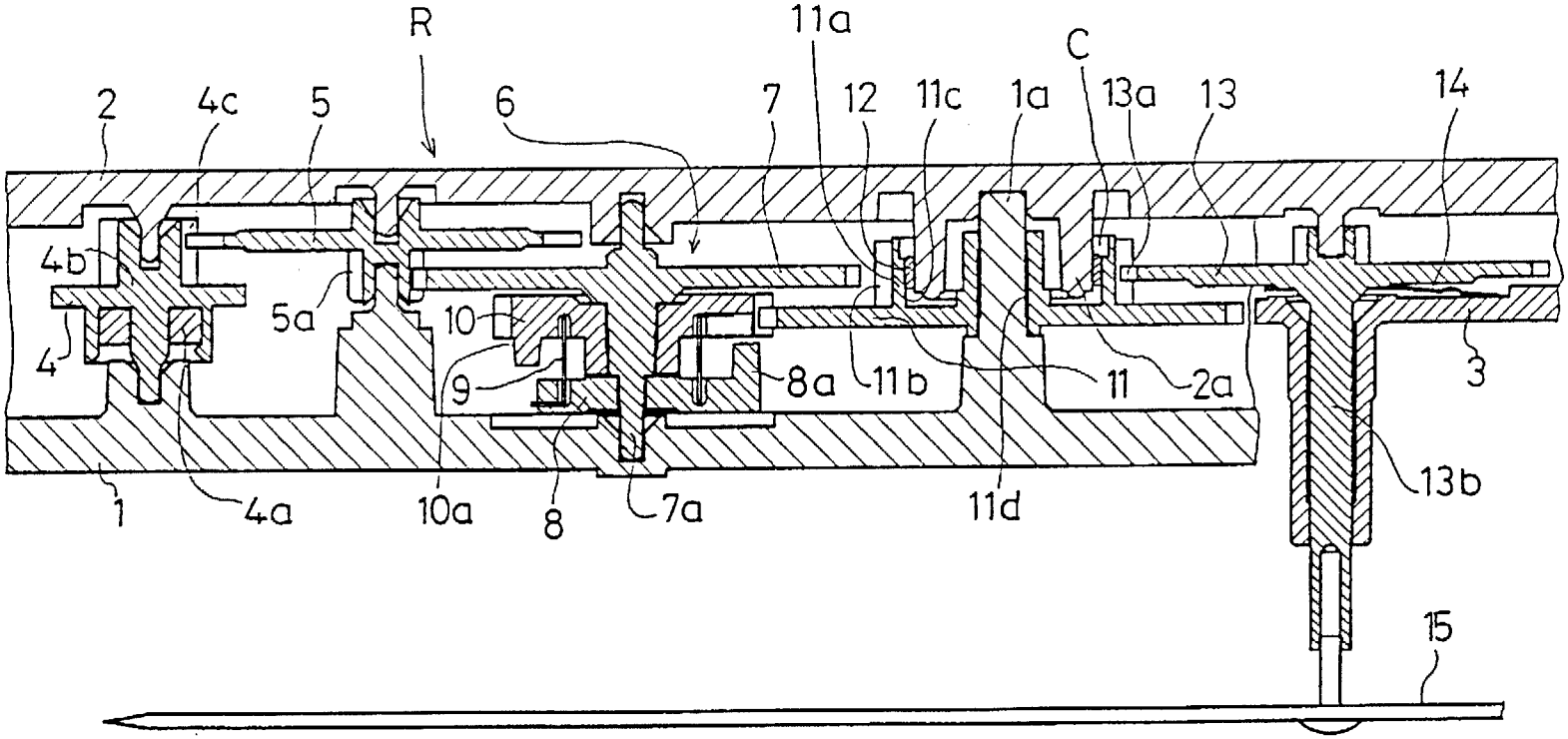
FIG. 1 is a cross-sectional view of an electronic apparatus embodying a viscous coupling gear device according to the present invention.
Figure 1:
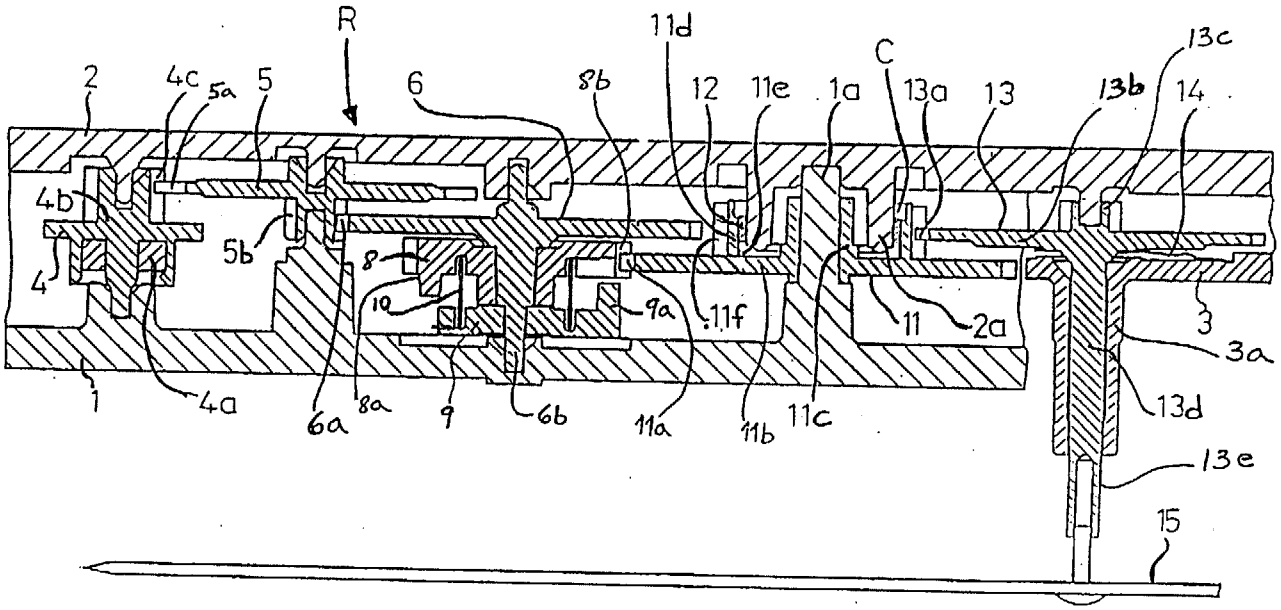
Figure 1:
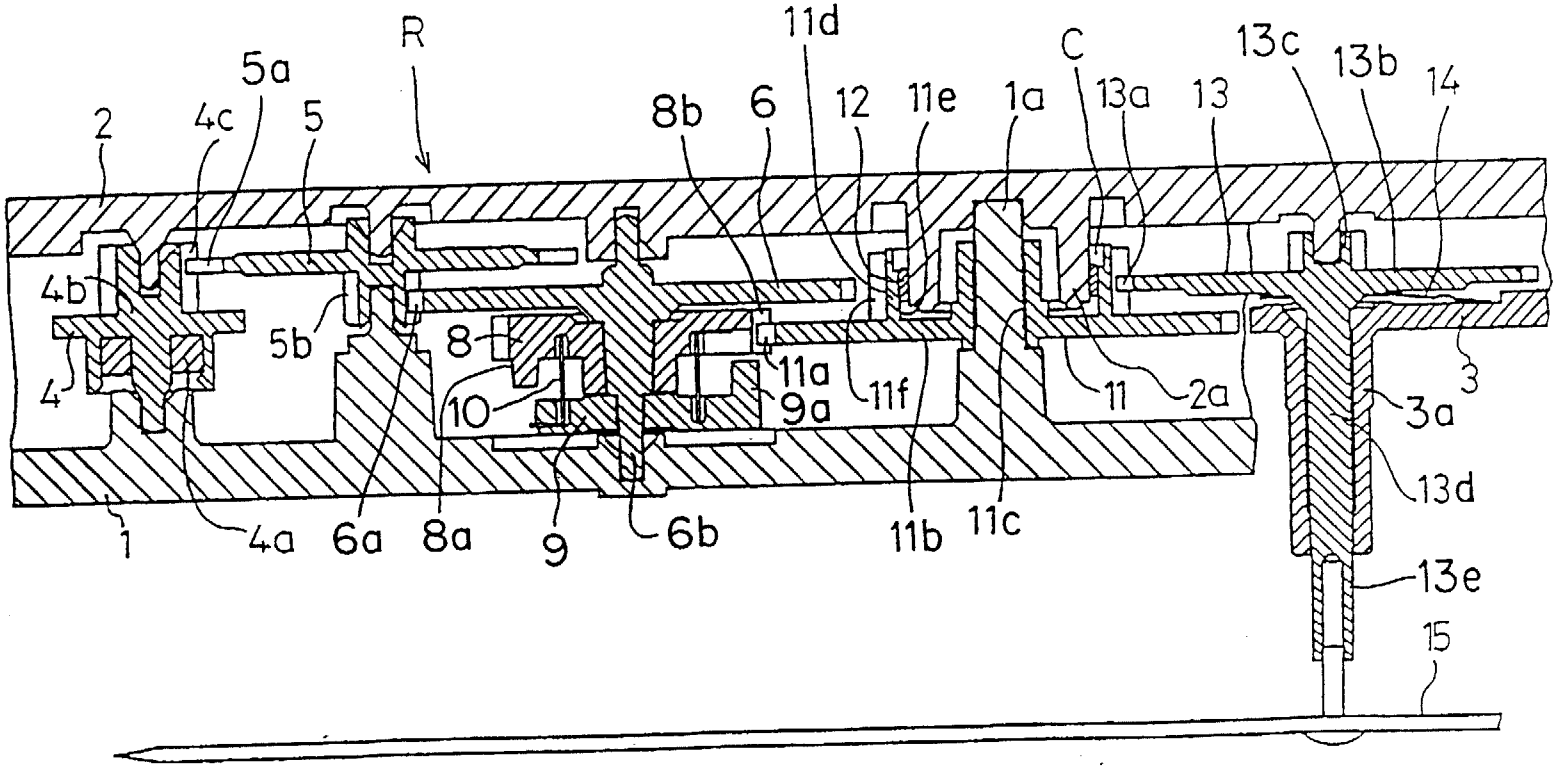

As shown in FIG. 1, a clock movement has a first or lower case a second or upper case 2 facing the lower case 1, and an intermediate plate 3 disposed between the upper and lower cases. Each of the lower case 1, upper case 2 and intermediate plate 3 has protrusions and bearing hole portions for supporting a reduction gear train R. The gear train R includes a rotor 4 which is driven by a conventional stepping motor (not shown) to rotate intermittently. The intermittent rotation of the rotor 4 is transmitted to a rotary member or fourth gear 13 to enable the fourth gear 13 to undergo smooth and continuous rotary motion, as will be described in further detail.

The rotor 4 has a magnet **4*a*, a rotor shaft 4*b* rotatably supported at opposite ends thereof by the lower case 1 and the upper case 2, and a rotor pinion 4*c* which forms an integral part of the rotor shaft 4*b* and is intermittently rotated by the stepping motor. The rotor pinion 4*c* meshes with a large diameter tooth portion 5*a* of a driving wheel 5. The driving wheel 5 has a small diameter tooth portion 5*b* which meshes with a large diameter tooth portion 6*a* of a rotary member or first gear 6 to transmit the intermittent rotation of the rotor pinion 4c to the first gear to thereby intermittently rotate the first gear The first gear 6 comprises a shaft portion 6b rotatably supported at opposite ends thereof by respective bearing hole portions of the lower case 1 and the upper case 2. A rotary member or second gear 8 is rotatably and coaxially fitted over the shaft portion 6b. A disk 9 is coaxially fitted over the shaft portion 6b for rotation therewith and is positioned between the second gear 8 and the lower case 1. An elastic member 10, such as a coil spring, is disposed coaxially with the shaft portion 6b and is supported by and between the disk 9 and the second gear 8 for transmitting the intermittent rotation of the disk 9 to the second gear 8. Upon rotation of the disk 9, the elastic member 10 is tightened and absorbs a torque from the disk 9 which is transferred to the second gear 8 to rotate the same. The elastic member 10 absorbs velocity variations due to the intermittent rotation of the disk 9, whereby a smooth, continuous rotary motion is transmitted to the second gear 8**.

The second gear 8 has a projection 8a, and the disk 9 has a projection 9a at its outer edge. The projections 8a,9a define means for preventing the elastic member 10 from being tightened beyond a predetermined allowable limit and breaking in the event that an unexpected load bears on the first gear 6. If any force bearing on the elastic member 10 tends to tighten it beyond the predetermined allowable limit, the projection 8a of the second gear 8 engages the projection 9a of the disk 9 to prevent further rotation of the disk 9 so that no further force may bear on the elastic member 10.

The second gear 8 has a tooth portion 8b which meshes with a driving or tooth portion 11a of a disk portion 11b of a fourth rotary member or third gear 11 for transmitting the rotation of the second gear 8 to the third gear 11. The third gear 11 is rotatably mounted on a protrusion 1a projecting from the lower case 1 and into a boss or tubular portion 11c of the third gear 11. A tubular wall portion 11d projects from an upper surface of the disk portion 11b and is disposed coaxially with and spaced from the tubular portion 11c to define a cavity 11e therebetween. The tubular wall portion 11d provides increased rigidity for the disk portion 11b to prevent it from being bent during operation of the gear device.

A pinion 11f forms an integral part of the tubular wall portion 11d and defines driving means for transmitting rotation of the third gear 11 to the fourth gear 13. A tubular protrusion 2a projects from the upper case 2 and is fitted coaxially over the tubular portion 11c of the third gear 11 and extends loosely into the cavity 11e. The tubular wall portion 11d, the cavity lie and the protrusion 2a define therebetween a clearance C. A viscous fluid 12, such as grease, is disposed within the clearance C for imparting a viscosity resistance load to the fourth gear 13. The cavity lie is also utilized for holding the viscous fluid employed as a means for imparting viscosity resistance.

The pinion 11f meshes with a large diameter tooth portion 13a of the fourth gear 13 for transmitting the rotation of the third gear to the fourth gear. The viscous fluid 12 functions as a lubricant for the rotation of the fourth gear 13 and, owing to its viscosity, also functions to absorb any variation in velocity due to the intermittent rotation transmitted from the first gear 6. Thus, the viscous fluid 12 completely absorbs any variation that still remains in the rotational velocity of the first gear 6 due to its intermittent nature, after absorption of velocity variation by the elastic member 10, so that the fourth gear 13 is able to undergo substantially smooth and continuous rotary motion.

The fourth gear 13 has a disk portion 13b, a tubular portion 13c extending from an upper surface of the disk portion 13b, and a shaft portion 13d extending from a lower surface of the disk portion 13b. The tubular portion 13c is rotatably mounted on a protrusion extending from the upper case 2. The shaft portion 13d projects through a tubular portion 3a of the intermediate plate 3 and passes through the lower case 1 to the outside, and a second indicating hand 15 is mounted on the projecting end 13e of the shaft portion 13d. Tubular portions or pipes (not shown) are fitted coaxially over the projecting end 13e of the shaft portion 13d in a conventional manner, and a minute indicating hand (not shown) and an hour indicating hand (not shown) are respectively mounted on the tubular portions in a conventional manner. A spring 14 is fitted between the disk portion 13b of the fourth gear 13 and the intermediate plate 3 in resilient contact therewith for restricting the motion of the fourth gear 13.

When the rotor 4 is intermittently rotated by the stepping motor (not shown), the intermittent rotation is transmitted to the first gear 6 by the driving wheel 5. The rotation of the first gear 6 is transmitted from the disk 9 to the second gear 8 by the elastic member 10. When the intermittent rotation transmitted to the disk 9 is transmitted by the elastic member 10, its velocity variation is absorbed by the elastic member 10 and a smooth, continuous rotary motion is transmitted to the second gear 8. The second gear 8, in turn, rotates the third gear 11 with which it meshes. At this point, the viscous fluid 12 completely absorbs any remaining variation in velocity after it is absorbed by the elastic member 10 so that the third gear 11 transmits a smooth and continuous rotational motion to the fourth gear 13 and, therefore, to the second indicating hand 15.

It is understood by those of ordinary skill in the art that the driving wheel 5, the first gear 6, the second gear 8, the disk 9, the third gear 11 and the fourth gear 13 may be fabricated by conventional manufacturing methods using suitable high strength, low weight materials. For example, the foregoing components may be fabricated by an injection molded process using a hard plastic material.

It will be appreciated by those of ordinary skill in the art that the cavity 11e facilitates the fabrication of the third gear 11 with high structural rigidity. In particular, when the third gear 11 is fabricated by a conventional molding process using a plastic material, the cavity 11e prevents a large quantity of plastic from flowing to the tubular portion 11c. The presence of the cavity 11e reduces the quantity of plastic material present at the boss or tubular portion 11c of the third gear 11 so that upon cooling of the injection molded third gear 11, only minimal compressive forces due to shrinkage of the plastic material are applied to the center region of the disk portion 11b. As a result, the outer peripheral portion of the disk portion 11b is not deformed or bent during cooling, so that the disk portion 11b remains flat (as opposed to becoming bowed or cupped) thereby ensuring full surface contact between the tooth portions 8b and 11a of the second gear 8 and the third gear 11.

The viscous coupling gear device of this invention enables a rotary member, such as a second hand wheel of a clock movement, to undergo substantially smooth and continuous rotary motion when a stepping motor is used as a source of driving force. Furthermore, since the viscous coupling gear device is small in thickness and has a simple structure, it can be miniaturized and mass-produced at a relatively low manufacturing cost.

I claim:

1. A viscous coupling gear device comprising: a first gear; means for intermittently rotating the first gear; a second gear; first transmitting means for transmitting the intermittent rotation of the first gear to the second gear; a third gear having a disk portion and a tubular portion extending from the disk portion; support means including a protrusion extending through the tubular portion of the third gear for rotatably supporting the third gear; second transmitting means for transmitting the rotation of the second gear to the third gear; a fourth gear; third transmitting means for transmitting the rotation of the third gear to the fourth gear; and first absorbing means for absorbing a velocity variation due to the intermittent rotation of the third gear to thereby transmit a smooth and continuous rotary motion to the fourth gear, the first absorbing means comprising a tubular wall portion extending from the disk portion of the third gear and disposed coaxially with and spaced from the tubular portion of the third gear to define a cavity therebetween, a tubular protrusion projecting from the support means and extending into the cavity to define a clearance between the tubular portion, the cavity and the tubular wall portion, and a viscous fluid disposed in the clearance.

2. A viscous coupling gear device as claimed in claim 1; wherein the second transmitting means comprises a tooth portion of the second gear in meshing engagement with a tooth portion of the third gear.

3. A viscous coupling gear device as claimed in claim 1; wherein the third transmitting means comprises a tooth portion of the tubular wall portion of the third gear in meshing engagement with a tooth portion of the fourth gear.

4. A viscous coupling gear device as claimed in claim 1; wherein the first transmitting means includes second absorbing means for absorbing a velocity variation due to the intermittent rotation of the first gear.

5. A viscous coupling gear device as claimed in claim 4; wherein the second absorbing means comprises a shaft portion of the first gear supporting the second gear for relative rotation therewith and having an end portion rotatably supported by the support means, a disk mounted on the shaft portion of the first gear for rotation therewith, and an elastic member disposed between the second gear and the disk.

6. A viscous coupling gear device as claimed in claim 5; wherein the elastic member comprises a coil spring.

7. A viscous coupling gear device comprising: a first case having a protrusion extending therefrom; a second case facing the first case and having a protrusion extending therefrom; a gear having a driving portion for driving engagement with a first rotary member undergoing intermittent rotation and for transmitting intermittent rotation to the gear, a tubular portion extending from the gear and mounted on the protrusion of the first case for relative rotation therewith, and a tubular wall portion extending from the gear and disposed coaxially with and spaced from the tubular portion to define a cavity therebetween, the protrusion of the second case extending into the cavity and defining, together with the cavity and the tubular wall portion, a clearance; driving means in driving engagement with a second rotary member for transmitting rotation of the gear to the second rotary member; and a viscous fluid disposed in the clearance of the gear for absorbing a velocity variation due to the intermittent rotation of the first rotary member so that the driving means transmits a smooth and continuous rotary motion to the second rotary member.

8. A viscous coupling gear device comprising: a first case having a protrusion extending therefrom; a second case having a protrusion extending therefrom; a first gear for undergoing intermittent rotation; a disk supported by the first gear for intermittent rotation therewith; a second gear supported between the first gear and the disk for relative rotation therewith, the second gear having a tooth portion; a third gear having a tooth portion for meshing engagement with the tooth portion of the second gear to transmit the rotation of the second gear to the third gear, a tubular portion extending from the third gear and mounted on the protrusion of the first case for relative rotation therewith, and a tubular wall portion extending from the third gear and disposed coaxially with and spaced from the tubular portion to define a cavity therebetween, the protrusion of the second case extending into the cavity and defining, together with the cavity and the tubular wall portion, a clearance; a pinion fitted coaxially over the tubular wall portion of the third gear and having a tooth portion; a fourth gear having a tooth portion for meshing engagement with the tooth portion of the pinion to transmit the rotation of the third gear to the fourth gear; and a viscous fluid disposed in the clearance for absorbing a velocity variation due to the intermittent rotation of the first gear so that a smooth and continuous rotary motion is transmitted to the fourth gear.

9. A viscous coupling gear device as claimed in claim 8; further comprising means for absorbing a velocity variation due to the intermittent rotation of the first gear.

10. A viscous coupling gear device as claimed in claim 9; wherein the means for absorbing a velocity variation due to the intermittent rotation of the first gear comprises a shaft portion of the first gear supporting the second gear for relative rotation therewith, the disk being mounted on the shaft portion of the first gear for rotation therewith, and an elastic member disposed between the second gear and the disk.

11. A viscous coupling gear device as claimed in claim 10; wherein the elastic member comprises a coil spring.

12. In a gear device having a first gears, means for intermittently rotating the first gear, at least a second gear, and a housing for supporting the respective gears, the improvement comprising: a viscous coupling for absorbing a velocity variation due to the intermittent rotation of the first gear to thereby transmit a smooth and continuous rotary motion to the second gear, the viscous coupling comprising a pair of upstanding tubular projections extending from a respective one of the gears, the tubular projections being spaced apart to define a gap, a projection extending from the housing into the gap, and a viscous fluid disposed in the gap.

13. An electronic timepiece with a sweep second hand comprising: an intermittently operable stepper motor; a first gear for communicating a rotary motion of the stepper motor to a shaft of the second hand; a rotary member coaxially arranged with the second hand shaft and engaged with the first gear; a gear train for transferring motion of the first gear to the rotary member to drive the second hand; a housing for supporting the first gear, the rotary member and the gear train; and a viscous coupling having a region in which a viscous fluid is accommodated for converting intermittent motion of the first gear into a smooth, continuous motion of the second hand; wherein the region for accommodating the viscous fluid is defined by a pair of upstanding tubular projections formed in a disc portion of one of the first gear, the rotary member, or one or more gears of the gear train.

14. An electronic timepiece according to claim 13; wherein the gear train comprises a second gear; first transmitting means for transmitting the intermittent rotation of the first gear to second gear; a third gear having a disk portion and a tubular portion extending from the disk portion; second transmitting means for transmitting the rotation of the second gear to the third gear; third transmitting means for transmitting the rotation of the third gear to the rotary member; wherein the viscous coupling is effective for absorbing a velocity variation due to the intermittent rotation of the first gear to thereby transmit a smooth and continuous rotary motion to the rotary member, and the viscous coupling comprises a tubular wall portion extending from the disk portion of the third gear and disposed coaxially with and spaced from the tubular portion of the third gear to define a cavity therebetween, a tubular protrusion projecting from the housing and extending into the cavity to define a clearance between the tubular portion and the tubular wall portion, and a viscous fluid disposed in the clearance.

15. An electronic timepiece according to claim 14; wherein the second transmitting means comprises a tooth portion of the second gear in meshing engagement with a tooth portion of the third gear.

16. An electronic timepiece according to claim 14; wherein the third transmitting means comprises a tooth portion of the tubular wall portion of the third gear in meshing engagement with a tooth portion of the rotary member.

17. An electronic timepiece according to claim 14; wherein the first transmitting means includes second absorbing means for absorbing a velocity variation due to the intermittent rotation of the first gear.

18. An electronic timepiece according to claim 17; wherein the second absorbing means comprises a shaft portion of the first gear supporting the second gear for relative rotation therewith and having an end portion rotatably supported by the housing, a disk mounted on the shaft portion of the first gear for rotation therewith, and an elastic member disposed between the second gear and the disk.

19. An electronic timepiece according to claim 18; wherein the elastic member comprises a coil spring.

* * * * *

UNITED STATES PATENT AND TRADEMARK OFFICE

CERTIFICATE OF CORRECTION

PATENT NO. : 5,746,092
DATED : May 5, 1998
INVENTOR(S) : Koji BABA

It is certified that error appears in the above-identified patent and that said Letters Patent is hereby corrected as shown below:

The title page should be deleted to appear as per attached title page.

Please delete drawing sheets 1 of 1 and substitute drawing sheets 1 of 1 as per attached.

Signed and Sealed this

Sixteenth Day of February, 1999

*Attest:*

*Attesting Officer*

*Acting Commissioner of Patents and Trademarks*

US005746092A

United States Patent [19]

Baba

[11] Patent Number: 5,746,092

[45] Date of Patent: May 5, 1998

[54] VISCOUS COUPLING GEAR DEVICE

[75] Inventor: Koji Baba, Tokyo, Japan

[73] Assignee: Seiko Clock Inc., Japan

[21] Appl. No.: 535,520

[22] Filed: Sep. 28, 1995

[30] Foreign Application Priority Data

Sep. 28, 1994 [JP] Japan ..... 6-233278

[51] Int. Cl.[6] ..... G04C 3/14

[52] U.S. Cl. ..... 74/421 R; 368/157; 368/160

[58] Field of Search ..... 74/421 R; 368/157, 368/160, 155; 188/293

[56] References Cited

U.S. PATENT DOCUMENTS

| | | | |
|---|---|---|---|
| 3,961,213 | 6/1976 | Koike et al. | 368/168 |
| 4,885,730 | 12/1989 | Miyazawa | 368/157 |
| 4,910,721 | 3/1990 | Hayakawa et al. | 368/155 |
| 5,151,886 | 9/1992 | Miyazawa | 368/157 |
| 5,197,045 | 3/1993 | Miyazawa | 368/157 |

FOREIGN PATENT DOCUMENTS

| | | | |
|---|---|---|---|
| 4-219537 | 8/1992 | Japan | 188/293 |
| 1441210 | 6/1976 | United Kingdom . | |
| 2197969 | 6/1988 | United Kingdom . | |
| 2253891 | 9/1992 | United Kingdom | 188/293 |
| 2281605 | 3/1995 | United Kingdom . | |

*Primary Examiner*—Rodney H. Bonck
*Assistant Examiner*—Troy Grabow
*Attorney, Agent, or Firm*—Adams & Wilks

[57] ABSTRACT

A viscous coupling gear device has a first case having a protrusion extending from a surface thereof, and a second case having a surface facing the surface of the first case and a protrusion extending from the surface of the second case. A gear has a driving portion for driving engagement with a first rotary member undergoing intermittent rotation and for transmitting intermittent rotation to the gear, a tubular portion extending from the gear and mounted on the protrusion of the first case for relative rotation therewith, and a tubular wall portion extending from the gear and disposed coaxially with and spaced from the tubular portion to define a cavity therebetween, the protrusion of the second case extending into the cavity and defining, together with the cavity and the tubular wall portion, a clearance. A driving member engages with a second rotary member for transmitting rotation of the gear to the second rotary member. A viscous fluid is disposed in the clearance for absorbing a velocity variation due to the intermittent rotation of the first rotary member so that the driving member transmit a smooth and continuous rotary motion to the second rotary member.

19 Claims, 1 Drawing Sheet

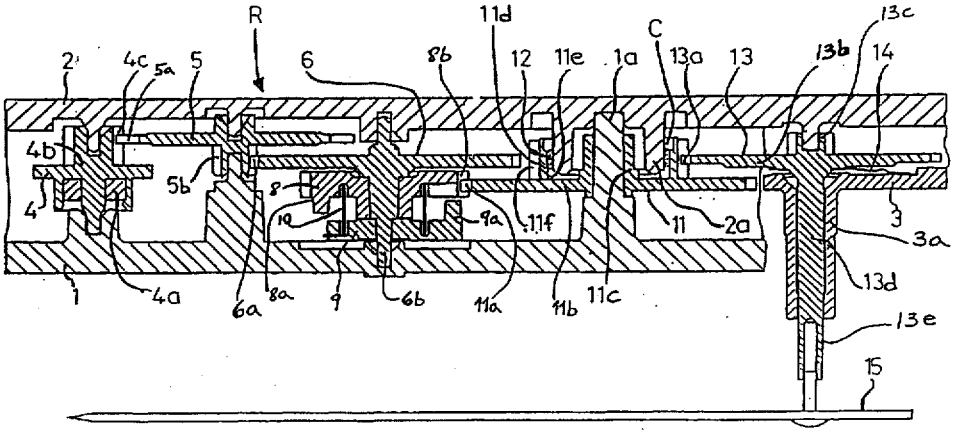

U.S. Patent May 5, 1998 5,746,092

UNITED STATES PATENT AND TRADEMARK OFFICE

CERTIFICATE OF CORRECTION

PATENT NO. : 5,746,092
DATED : May 5, 1998
INVENTOR(S) : Koji BABA

It is certified that error appears in the above-identified patent and that said Letters Patent is hereby corrected as shown below:

The title page should be deleted to appear as per attached title page.

Please delete drawing sheets 1 of 1 and substitute drawing sheets 1 of 1 as per attached.

This certificate supersedes Certificate of Correction issued February 16, 1999.

Signed and Sealed this

Twenty-seventh Day of July, 1999

*Attest:*

Q. TODD DICKINSON

*Attesting Officer*

*Acting Commissioner of Patents and Trademarks*

United States Patent [19]

Baba

[11] Patent Number: 5,746,092

[45] Date of Patent: May 5, 1998

[54] VISCOUS COUPLING GEAR DEVICE

[75] Inventor: Koji Baba, Tokyo, Japan

[73] Assignee: Seiko Clock Inc., Japan

[21] Appl. No.: 535,520

[22] Filed: Sep. 28, 1995

[30] Foreign Application Priority Data

Sep. 28, 1994 [JP] Japan ..... 6-233278

[51] Int. Cl.[6] ..... G04C 3/14

[52] U.S. Cl. ..... 74/421 R; 368/157; 368/160

[58] Field of Search ..... 74/421 R; 368/157, 368/160, 155; 188/293

[56] References Cited

U.S. PATENT DOCUMENTS

| | | | |
|---|---|---|---|
| 3,961,213 | 6/1976 | Koike et al. | 368/168 |
| 4,885,730 | 12/1989 | Miyazawa | 368/157 |
| 4,910,721 | 3/1990 | Hayakawa et al. | 368/155 |
| 5,151,886 | 9/1992 | Miyazawa | 368/157 |
| 5,197,045 | 3/1993 | Miyazawa | 368/157 |

FOREIGN PATENT DOCUMENTS

| | | | |
|---|---|---|---|
| 4-219537 | 8/1992 | Japan | 188/293 |
| 1441210 | 6/1976 | United Kingdom . | |
| 2197969 | 6/1988 | United Kingdom . | |
| 2253891 | 9/1992 | United Kingdom | 188/293 |
| 2281605 | 3/1995 | United Kingdom . | |

*Primary Examiner*—Rodney H. Bonck
*Assistant Examiner*—Troy Grabow
*Attorney, Agent, or Firm*—Adams & Wilks

[57] ABSTRACT

A viscous coupling gear device has a first case having a protrusion extending from a surface thereof, and a second case having a surface facing the surface of the first case and a protrusion extending from the surface of the second case. A gear has a driving portion for driving engagement with a first rotary member undergoing intermittent rotation and for transmitting intermittent rotation to the gear, a tubular portion extending from the gear and mounted on the protrusion of the first case for relative rotation therewith, and a tubular wall portion extending from the gear and disposed coaxially with and spaced from the tubular portion to define a cavity therebetween, the protrusion of the second case extending into the cavity and defining, together with the cavity and the tubular wall portion, a clearance. A driving member engages with a second rotary member for transmitting rotation of the gear to the second rotary member. A viscous fluid is disposed in the clearance for absorbing a velocity variation due to the intermittent rotation of the first rotary member so that the driving member transmit a smooth and continuous rotary motion to the second rotary member.

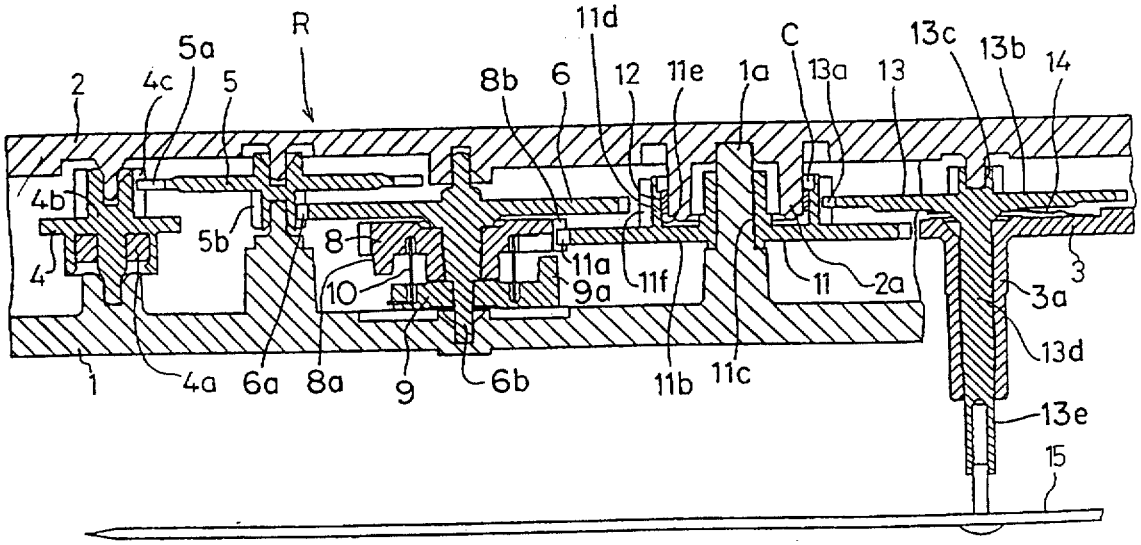

19 Claims, 1 Drawing Sheet